US008933850B2

(12) United States Patent
Goetz et al.

(10) Patent No.: US 8,933,850 B2
(45) Date of Patent: Jan. 13, 2015

(54) TRI-BAND ANTENNA

(75) Inventors: Christopher John Goetz, Hamburg, NY (US); Richard W. Leach, Tonawanda, NY (US)

(73) Assignee: STI-CO Industries, Inc., Orchard Park, NY (US)

( * ) Notice: Subject to any disclaimer, the term of this patent is extended or adjusted under 35 U.S.C. 154(b) by 505 days.

(21) Appl. No.: 13/303,988

(22) Filed: Nov. 23, 2011

(65) Prior Publication Data

US 2013/0127676 A1 May 23, 2013

(51) Int. Cl.
*H01Q 1/32* (2006.01)
*H01Q 21/30* (2006.01)
*H01Q 9/32* (2006.01)

(52) U.S. Cl.
CPC ..... *H01Q 1/3275* (2013.01); *H01Q 21/30* (2013.01); *H01Q 9/32* (2013.01)
USPC ..... 343/715; 343/751; 343/888

(58) Field of Classification Search
CPC ..... H01Q 7/005; H01Q 1/3258; H01Q 21/30; H01Q 9/32; H01Q 1/3275
USPC ..... 343/715, 893, 900, 745, 749, 888, 751
See application file for complete search history.

(56) References Cited

U.S. PATENT DOCUMENTS 4,228,544 A 10/1980 Guyton
5,926,143 A * 7/1999 Tran ..... 343/715
6,078,295 A 6/2000 Rawle
7,602,345 B2 10/2009 Chominski
7,859,477 B2 * 12/2010 Birnbaum et al. ..... 343/830
2004/0196179 A1 10/2004 Turnbull
2004/0196191 A1 10/2004 Hung et al.
2006/0044198 A1 * 3/2006 Tsai et al. ..... 343/715
2009/0002246 A1 * 1/2009 Rabinovich et al. ..... 343/713

OTHER PUBLICATIONS

OPEK, Printouts from website at http://edm.opek.com, pp. 201-226, Nov. 16, 2011.
Sti-Co Industries, Inc. Interoperable Mobile Antenna, Single Multi-frequency Antenna for Interoperability in Vehicles, 2009.
Printout from TESSCO Technologies, Inc. Website, Feb. 2010.
(Continued)

*Primary Examiner* — Dieu H Duong
(74) *Attorney, Agent, or Firm* — Kenneth J. Lukacher Law Group

(57) ABSTRACT

A tri-band antenna (10) is provided having a pair of antenna elements (12, 14), in which the first antenna element (14) operates in a first UHF frequency band, and the second antenna element (12) operates in a second VHF band and a third cellular frequency band. The bottom end (12*a*, 14*a*) of each of the antenna elements (12, 14) is fixed into a first member (16) from which the antenna elements extend parallel and spaced apart from each other to their different respective heights. A second member (13) couples the antenna elements (12, 14) to each other at a distance from the first member (16) to adjust the operation of the tri-band antenna (10) in at least the UHF band. A base member (19) is provided for mounting the tri-band antenna (10) along a surface of a vehicle. A signal feed member (20) extends through the base member (19) and has one end (20*a*) attached to the first member (16) and another end (20b) providing a RF connector. The signal feed member (20) provides the antenna elements (12, 14), via the first member (16), with a common signal path for transmission and reception of RF signals in all three bands.

19 Claims, 6 Drawing Sheets

(56) References Cited

OTHER PUBLICATIONS

Opek, High Performance HF/VHF/UHF 4-Band Mobile Communication Antenna, Model HVU-200, 2007.

Opek, High Performance HF/VHF 10-Band Mobile Communication Antenna, Model HVT-600, 2009.

Opek, High Performance HF/VHF/UHF 8-Band +2-Band Mobile Communication Antenna, Model HVT-400B, 2009.

* cited by examiner

TRI-BAND ANTENNA

FIELD OF THE INVENTION

The present invention relates to a tri-band antenna, and in particular to an antenna operable simultaneously in three separate frequency bands using two antenna elements having a common signal path through a base member mountable along an exterior surface of a vehicle. The present invention is useful for providing a single antenna having wide bandwidth operation in each of its three bands, such as VHF, UHF, and cellular frequency bands.

BACKGROUND OF THE INVENTION

Multiple radio systems are often present in vehicles, such as cars, trucks, or boats, each operative in a different frequency band. Typically, one antenna for each band is used. Separate mounting hardware via a drilled hole in the exterior surface of the vehicle (e.g., roof or trunk in the case of an automobile) is thus required for each antenna. Also, there is a risk of RF interference between antennas if improperly positioned with respect to each other. Accordingly, single multiple band antennas have been designed to simplify installation. For example, an antenna operable in VHF, UHF, and cellular frequency bands is the Multi-Frequency Antenna, Model no. MGNT-TB-V/U/C, manufactured by STI-CO Industries, Inc. of Orchard Park, N.Y. Although this antenna provides the desired tri-band performance, its design has been considered non-esthetically pleasing when mounted on a vehicle due to its eight radially spaced antenna elements that extend from the mounting base about a mast antenna element. The eight radially spaced antenna elements creates a cage-like appearance, especially due to the star shaped plate coupled to the eight antenna elements near the tops thereof to retain their position with respect to the central antenna element. Also, as the vehicle travels wind passing through this antenna's multiple elements can cause undesirable noise, such as whistling. Thus, a tri-band antenna is desirable having fewer antenna elements while providing similar tri-band performance to the above cited STI-CO antenna thereby avoiding undesirable noise and provide a more aesthetically pleasing appearance.

Other multi-band antennas exist which rely instead on a single mast design, but often have narrow bandwidth bands making such antennas more limited in their applications. Moreover, some antennas are called multi-band, but cannot provide simultaneous operation at each of their multiple bands. For example, single mast multi-band antennas are manufactured by Autotek Limited of Taiwan under brand Opek®.

SUMMARY OF THE INVENTION

It is an object of the present invention to provide a tri-band antenna utilizing two antenna elements which overcomes the drawbacks of the prior art.

It is another object of the present invention to provide a tri-band antenna using two antenna elements while providing a wide bandwidth in each of the bands, particularly, VHF, UHF, and cellular bands.

It is a further object of the present invention to provide a tri-band antenna using two vertically aligned antenna elements which is adjustable in operation in at least one of its bands by a conductive member vertically slidable along the antenna elements.

Briefly described, the present invention embodies a tri-band antenna having a pair of antenna elements, in which a first of the antenna elements operates to provide a UHF frequency band, and a second of the antenna elements operates to provide a VHF band and a cellular frequency band. The bottom end of each of the antenna elements is fixed into a first member (adapter member) from which the antenna elements extend to their different respective heights (e.g., parallel and spaced apart from each other). A second member (adjusting member) couples the antenna elements to each other at a distance from the adapter member which adjusts the operation of the tri-band antenna in at least the UHF band. Attachable to the adapter member is a signal feed member to provide the antenna elements, via the first member, with a common signal path for transmission and reception of RF signals in all three bands. To mount the tri-band antenna along an external surface of a vehicle, a base member is provided and the signal feed member extends through such base member and has one end attached to the first member and another end providing a RF connector.

The adjusting member is provided to adjust the resonance of the first of the antenna elements which operates in the UHF band by reducing the presence in the signal path of resonance in the UHF band of the second antenna elements which would otherwise negatively effect performance of the tri-band antenna in the UHF band. Preferably, the antenna elements (e.g., rods) are slidable in a pair of holes of the adjusting member to a desired distance to enable the desired operation of the tri-band antenna in the UHF band, and then the adjusting member is fixed to the antenna elements to maintain such adjusted operation.

In the preferred embodiment, the tri-band antenna has two vertically aligned antenna elements providing whip (or mast) antennas of different heights that are coupled by two brass members (adapter and adjusting members) horizontally spaced from each other, in which the lower member is coupled to a single feed member extending from a mounting base, and the upper member enables adjustment of the operation of the tri-band antenna in at least one of its bands.

The present invention also embodies a method for providing an antenna having separate first, second and third frequency bands using a pair of antenna elements in which one of the antenna elements operates to provide a first frequency band, and the other of the antenna elements operates to provide second and third frequency bands. The method has the steps of: fixably engaging a first end of each of the antenna elements to a first member in which the antenna elements extend away from the first member to their respective second end; coupling a second member to the antenna elements at a location spaced a distance from the first member to adjust the operation of at least the one of the antenna elements in the first frequency band; attaching a third member to the first member to provide the antenna elements, via the first member, with a common signal path for transmission and reception of signals in all three bands; and attaching a base member for mounting the tri-band antenna along an external surface of a vehicle in which the third member extends through the base member prior to carrying out the step of attaching the third member to the first member.

BRIEF DESCRIPTION OF THE DRAWINGS

The foregoing objects, features and advantages of the invention will become more apparent from a reading of the following description in connection with the accompanying drawings in which.

DETAILED DESCRIPTION OF THE INVENTION

Figure 1:
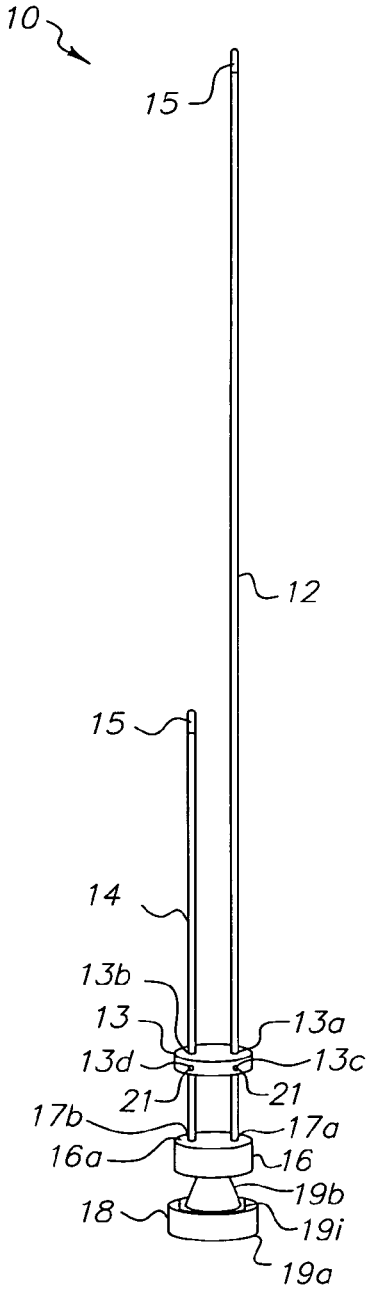
FIG. 1 is a perspective view of the antenna of the present invention.
Figure 2:
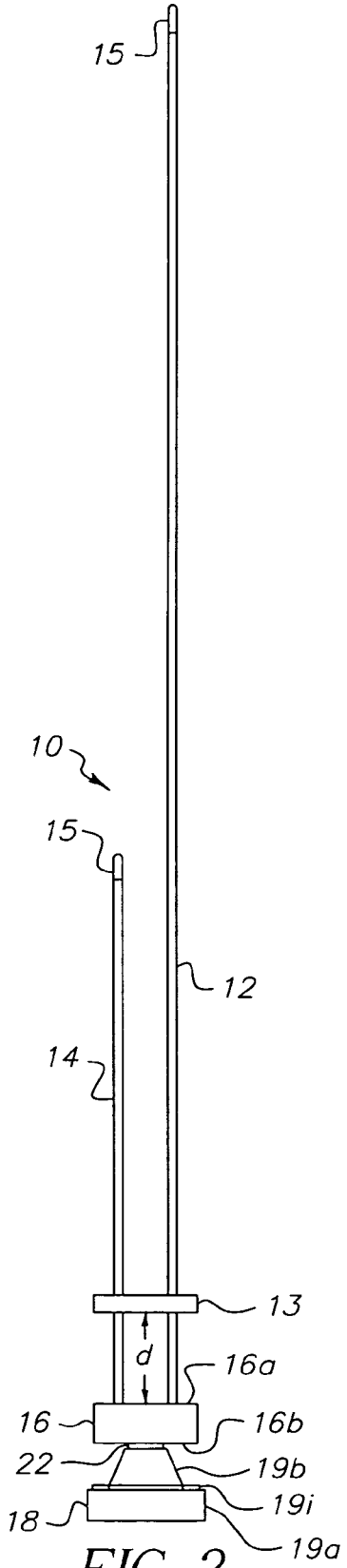
FIG. 2 is front view of the antenna of FIG. 1.
Figure 3:
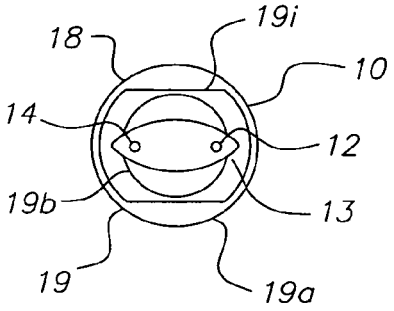
FIG. 3 is a top view of the antenna of FIG. 1 without protective caps over the upper ends of the antenna elements.
Figure 8A:
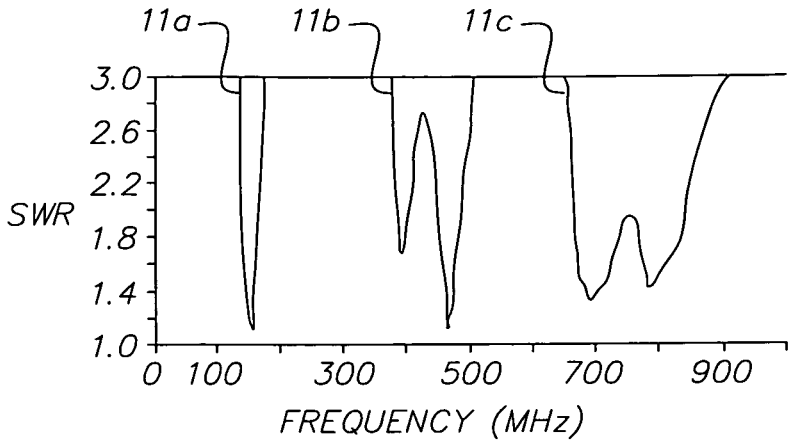
FIG. 8A is a Voltage Standing Wave Ratio (VSWR) versus frequency plot of the antenna of FIG. 1 showing the performance of antenna of FIG. 1 in UHF, VHF, and CEL bands.

Referring to FIGS. 1-4, the antenna 10 of the present invention is shown having two antenna elements 12 and 14 each mounted at one end 12*a* and 14*a*, respectively, to an adapter member 16 attached to a base assembly 18. Antenna elements 12 and 14 are commonly called whip antennas, and extend away from adapter member 16 parallel (or at least substantially parallel) to each other in a vertical direction, and spaced apart from each other in a horizontal direction (or at least substantially horizontal), to their different respective heights, as shown in FIGS. 1 and 2. Each has a mast of a length to provide the desired resonant RF wavelengths. For example, antenna elements 12 and 14 may be 18 inches and 8.2 inches in length, respectively, from the bottom of adapter member 16, where each element is a ⅛ inch diameter stainless steel vertical rod. Preferably elements 12 and 14 are linear and extend parallel to each other until the height of element 14 is reached. Each of the antenna elements 12 and 14 are coupled to each other both by adapter member 16 and an adjusting member 13, which is spaced a distance from adapter member 16 for adjusting or tuning antenna 10, as described in more detail below. Antenna 10 is a tri-band antenna in the VHF, UHF, and CEL (cellular) bands, such as 138-174 MHz for VHF, 380-512 MHz for UHF, and 764-870 MHz for CEL, where an example of its performance over these bands is shown in FIG. 8A by reference numerals 11*a*, 11*b*, 11*c*, respectively.

Figure 8B:
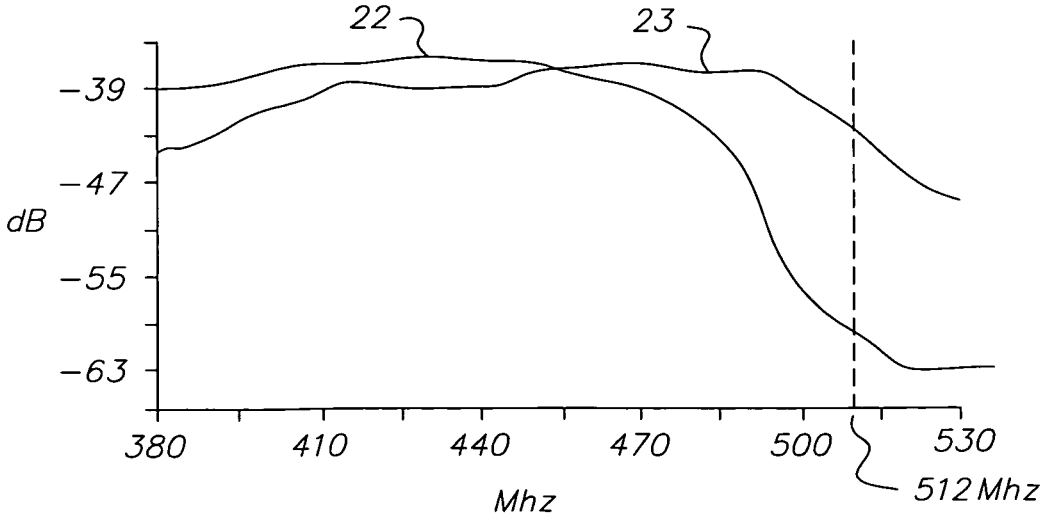
FIG. 8B is a gain versus frequency plot for the antenna showing the response of the antenna in the UHF band with and without the adjusting member of FIG. 1.
Figure 9A:
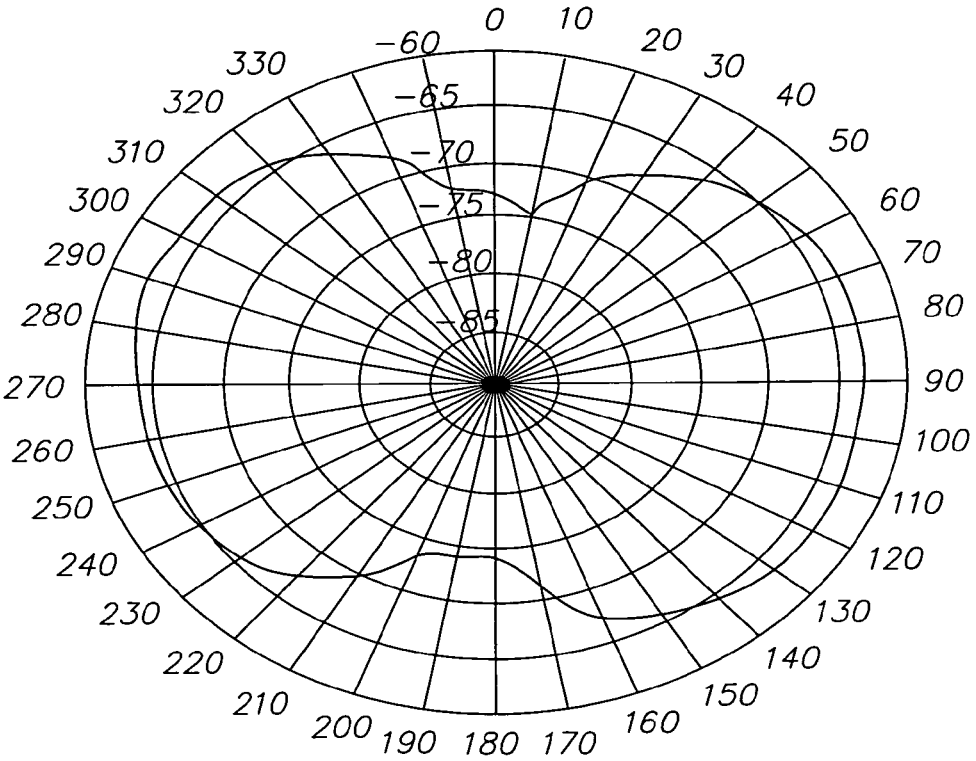
FIGS. 9A, 9B, and 9C are elevation plots showing the x-y plane radiation pattern of the antenna of FIG. 1 at 162 MHz, 440 MHz, and 860 MHz, respectively, where each represents a mid range frequency in the UHF, VHF, and CEL bands, respectively.
Figure 9B:
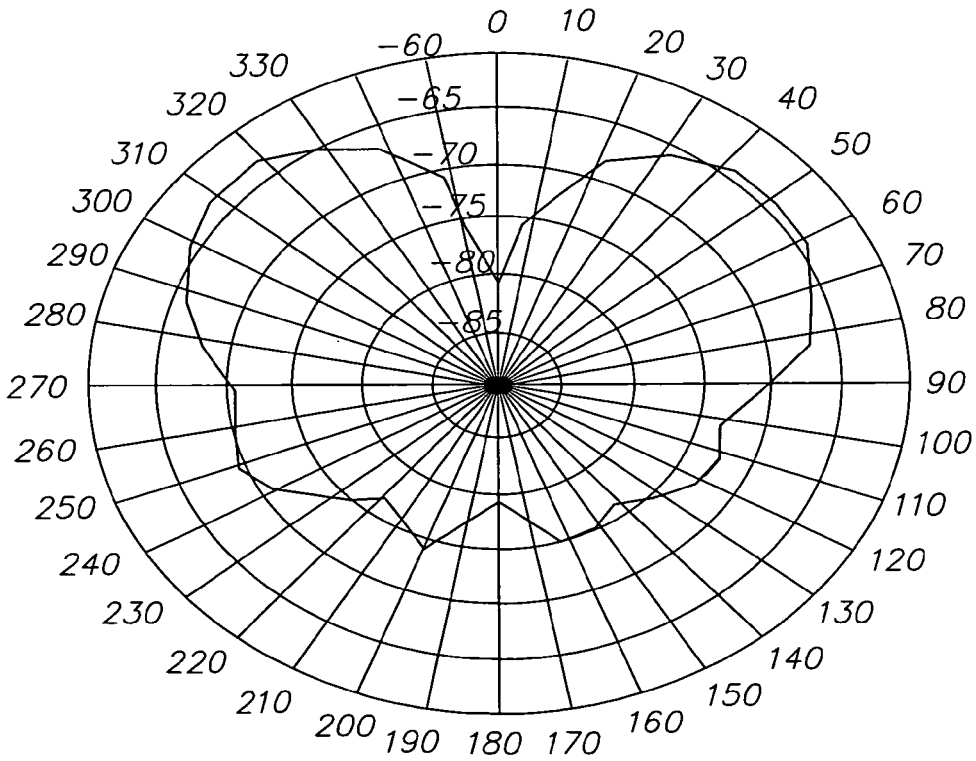
Figure 9C:
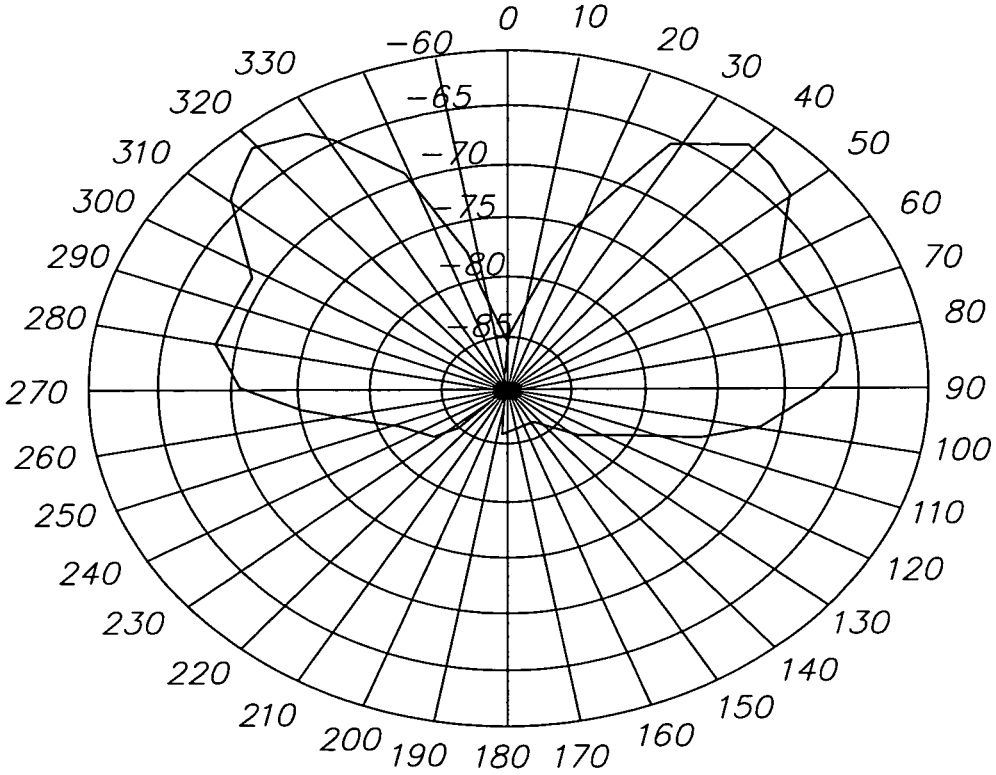

In terms of harmonic resonances, antenna element 12 has resonance at ¼λ (wavelength) for VHF frequencies, and resonance at ⅝λ for CEL (cellular) frequencies, while antenna element 14 has resonance at ¼λ for UHF frequencies. The adjusting member 13 is provided principally to adjust or tune antenna 10 in the UHF band. With adjusting member 13 properly spaced a distance from adapter member 16, the gain at ¼λ resonance of antenna element 14 increases, which would otherwise be reduced by the presence of an undesirable resonance by antenna element 12 at ¾λ which is in the frequency range of the UHF band. This is illustrated over the UHF frequencies by the gain versus frequency plot of FIG. 8B. Response 22 is the antenna 10 gain without adjusting member 13 showing an undesirable drop off at higher UHF frequencies from about 490 MHz to 512 MHz, while response 23 is the gain of antenna 10 of FIGS. 1-4 with adjusting member 13 at a desired set distance from adapter member 16 which increases the gain at the higher UHF frequency with slight tradeoff in gain at lower UHF frequencies. For example, this set distance is denoted by arrows d between members 13 and 16 of FIG. 2. The adjusting member 13 shorts the two antenna elements 12 and 14 to each other, changing the inductance, to primarily effect frequencies related to the UHF band. It is believed that adjusting member 13 effect on gain in the VHF and CEL bands is minimal. FIGS. 9A, 9B and 9C illustrate the elevation patterns at an exemplary frequency of 162 MHz, 440 MHz, and 860 MHZ in VHF, UHF, and CEL bands, respectively.

Figure 6A:
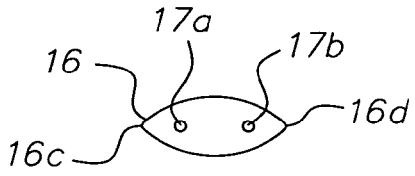
FIGS. 6A, 6B, and 6C are top, side and bottom views, respectively, of the adapter member of the antenna of FIG. 1 shown as a separate piece part.
Figure 6B:
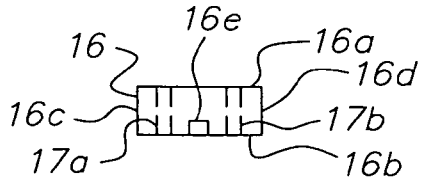
Figure 6C:
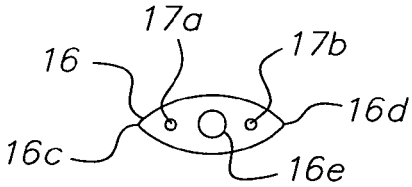

To assemble antenna 10, each antenna element 12 and 14 is received into two holes 17*a* and 17*b* extending through adapter member 16, such that ends 12*a* and 14*a* of the antenna elements 12 and 14, respectively, extend via respective holes 17*a* and 17*b* from top 16*a* until flush with the bottom 16*b* of adapter member 16. The distance between holes 17*a* and 17*b* sets the horizontal spacing of antenna elements 12 and 14 from each other as they extend vertically from adapter element 16. The adapter member 16 preferably is an ellipse shape in cross-section, as shown in FIGS. 6A-6C. For example, adapter member 16 may be a horizontal member made of brass, 1.25 inch long (major ellipse axis), 0.5 inch width (minor ellipse axis), 0.5 inches high, and its ends 16*c* and 16*d* slightly rounded. The holes 17*a* and 17*b* are slightly less than the diameter of antenna elements 12 and 14 so when ends 12*a* and 14*a* are pressed into adapter member 16 they fixedly engage the adapter member. The bottom 16*b* of the adapter member 16 has a threaded opening 16*e* which mates with a threaded shaft 20*a* of a signal feed member 20 of mounting base assembly 18, as will be described below in more detail.

In the example of antenna elements 12 and 14 being ⅛ inches each in diameter, the holes 17*a* and 17*b* may be 0.122 each in diameter and drilled parallel to each other through adapter member 16, such that ends 12*a* and 14*a* of the antenna elements 12 and 14, respectively, engage the sides of the holes 17*a* and 17*b* when disposed therein, so as to fixedly engage antenna elements 12 and 14 to adapter member 16. Preferably, the center of holes 17*a* and 17*b* are 0.70 inches apart; thereby the horizontal spacing between the elements 12 and 14 is 0.588 inches at adapter member 16 which should be the same along the length of antenna elements 12 and 14 until the height of element 14. Holes 17*a* and 17*b* are spaced equally from their respectively ends 16*b* and 16*c*, such as by 0.275 inches. Opening 16*e* may have an interior diameter of 0.272 inches and 5/16 inches deep.

Figure 7A:
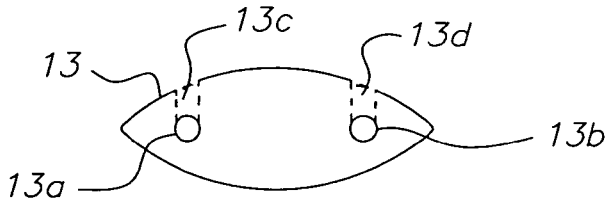
FIGS. 7A and 7B are top and side views, respectively, of the adjusting member of the antenna of FIG. 1 shown as a separate piece part.
Figure 7B:
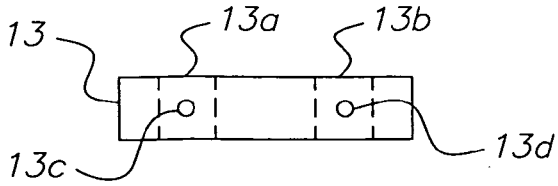

Adjusting member 13 is a horizontal member, such as shown in FIGS. 7A and 7B, having two openings (or holes) 13*a* and 13*b* extending there though for enabling adjusting member 13 to receive antenna element end 12*b* in opening 13*a*, slide down antenna element 12 via opening 13*a* until reaching the height of antenna element 14, receive antenna element end 14*b* in opening 13*b*, and then slide (travel or move) along both antenna elements 12 and 14 via openings 13*a* and 13*b* either towards or away from adapter member 16 as needed. As such antenna 10 can be tuned by sliding adjusting member 13 along antenna elements 12 and 14 via holes 13*a* and 13*b*, respectively, until it is vertically spaced above adapter member 16 by a distance (e.g., arrows d of FIG. 2) which provides the desired antenna performance, as described above. When at the desired distance, member 13 is retained at that distance by two set screws 21 received in threaded openings 13*c* and 13*d* and tighten against the outer surface of antenna elements 12 and 14, respectively. An adhesive or sealant, such as LOCTITE®, is preferably provided into openings 13*c* and 13*d*, prior to inserting set screws 21 so as to preserve and retain the position of the member 13 in antenna 10 along antenna elements 12 and 14. Preferably, the adapter and adjusting members are spaced a distance of 1.07 inches apart from each other to enable the desired antenna performance (see, e.g., FIGS. 8A, 8B and 9A-C). Adjusting member 13 preferably is of an elliptical shape in cross-section, as shown in FIG. 7A. A protective cap 15 is then fitted over and attached by epoxy to each of ends 12*b* and 14*b* of antenna elements 12 and 14, respectively. Caps 15 may be made of plastic, and 0.5 inches in length. Alternatively, antenna elements 12 and 14 may be slidably coupled through adjusting member openings 13*a* and 13*b* prior to antenna elements 12 and 14 being fixed to adapter member 16.

For example, adjusting member 13 may be of brass, 1.25 inch long (major ellipse axis), 0.5 inch width (minor ellipse axis), 0.25 inches high, and its ends along the major ellipse axis slightly rounded as shown in FIG. 7A. The holes 13*a* and 13*b* are slightly more than the diameters of each of antenna elements 12 and 14 so as enable ease of sliding antenna elements 12 and 14 into holes 13*a* and 13*b*, respectively, and then member 13 to its desired tuning position. In the example of antenna elements 12 and 14 being ⅛ inches each in diameter, the holes 13*a* and 13*b* may be 0.126 inches each in diameter and are drilled parallel to each other through adjusting element 13. The position of holes 13*a* and 13*b* in adjusting member 13 align vertically with position of holes 17*a* and 17*b*, respectively, in adapter member 16, in accordance with the vertical alignment of antenna elements 12 and 14, respectively, in antenna 10 where such holes of each member 16 and 13 are shown in FIGS. 6C and 7B, respectively.

Figure 4:
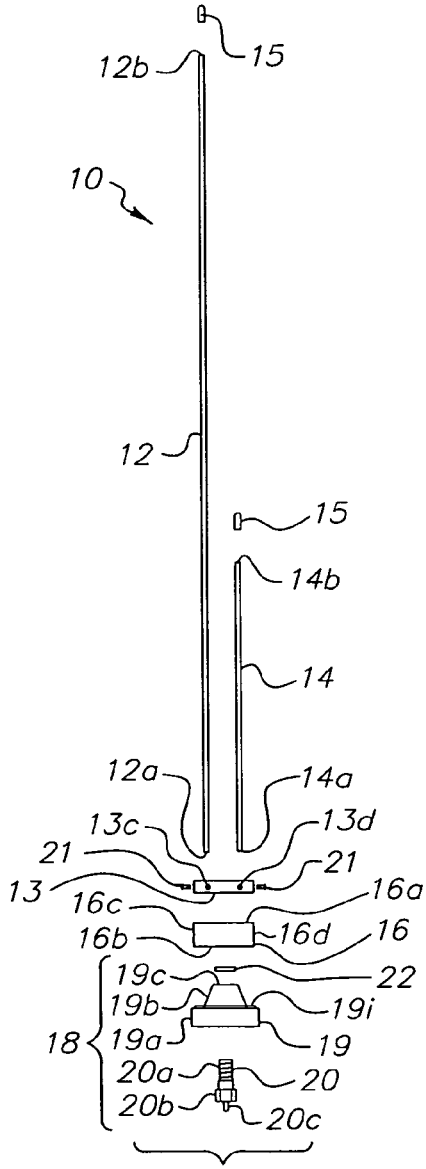
FIG. 4 is an exploded view of the antenna array of FIG. 1.
Figure 5:
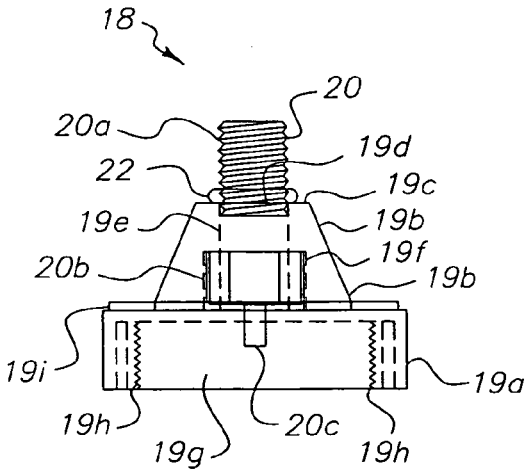
FIG. 5 is a schematic side view of the completed mounting base assembly of the antenna of FIG. 1.

Referring to FIGS. 4 and 5, the mounting base assembly 18 has a base member 19, signal feed member 20, and an O-ring 22. Base member 19 has a lower cylindrical portion 19*a* that extends to an upper conical portion 19*b* having a truncated top 19*c* with an opening 19*d* to a bore 19*e* which extends centrally through conical portion 19*b*. Bore 19*e* is sized to receive the signal feed member 20, such that when member 20 is received in bore 19*e* the threaded shaft 20*a* of member 20 at least substantially extends upwards through opening 19*d* and the hex portion 20*b* of signal feed member 20 is received in portion 19*f* of bore 19*e* to prevent rotation of signal feed member 20 with respect to base member 19. The signal feed member 20 is retained to base member 19 by an O-ring 22 placed over shaft 20*a* abutting top surface 19*c* of base member 19. The bottom of lower portion 19*a* is open and its cylindrical wall is threaded along its interior surface 19*h*. The base member 19 is preferably of non-conductive material, such as molded plastic, and has an upper surface 19*i* along its portion 19*a* providing a step or ledge around the base of conical portion 19*b*. The shape of upper surface 19*i* is best shown in the top view of antenna 10 shown in FIG. 3.

With mounting base assembly 18 complete, the shaft 20*a* extending from assembly 18 is tightened in threaded hole 16*e* of adapter member 16 which is part of a completed assembly of antenna elements 12 and 14, adapter member 16, and adjusting member 13 as described above. Preferably, the adjusting member 13 is fixed in its desired position along elements 12 and 14 prior to attachment to mounting base assembly 18, but the position of adjusting member 13 may be set when desired. This completes the assembly of antenna 10.

The signal feed member 20 is of a conductive material, providing antenna elements 12 and 14 with a common signal path, via conductive adapter member 16, to the bottom of hex portion 20*b* and a central pin 20*c* extending downward into an open cavity 19*g* defined by the interior upper wall and side wall of base member 19. The pin 20*c* floats on a coil spring in a chamber in member 19 which biases the pin downward. Lower portion 20*b* and pin 20*c* of the signal feed member 20 provide a typical antenna connector for an antenna cable (not shown).

The base member 19 and signal feed member 20 shown in the figures are products manufactured by Whisco Component Engineering, Inc. of Glendale Height, Ill., where base member 19 is Base—Part no. 11B, and member 20 is Spring Contact—Part no. 11 SC. A typical feed contact pin may also provide signal feed member 20. For example, the bottom portion 19*a* has an outer diameter of 1.43 inches. The overall height of the mounting base 18 may be 0.84 inches, with half of this height due to the height of lower portion 19*a*. The type of base mount assembly 18 is of an NMO type. Other NMO or non-NMO type mounting bases may also be used having a threaded portion receivable in hole 16*c* of adapter member 16, or other such attachment means provided, and as such, the mounting base assembly 18 of antenna 10 is not limited to that illustrated in the figures.

Figure 10:
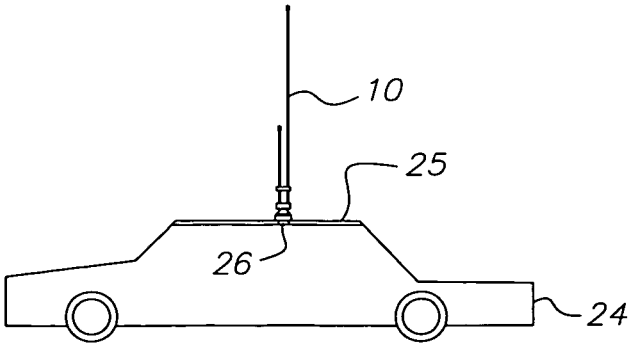
FIG. 10 is example of the antenna of FIG. 1 mounted on the roof of a vehicle.

The antenna 10 is mountable to vehicle 24 at a location upon its external surface 25 (e.g., trunk or roof) as shown for example in FIG. 10, using NMO hardware (not shown) such as specified for the particular base assembly 18 manufacturer, or as desired by the installer. For example, hardware (not shown) may extend upward, via a drilled hole 26 through surface 25, having a threaded outer circumference mated for tightening along threaded surface 19*h* of the base assembly 18. With the base assembly 18 now mounted upon vehicle 24, the RF connector provided by the signal feed member's portion 20*b* and pin 20*c* is presented, via the hole 26, for connection to a typical RF antenna cable (not shown). Such cable can thereby provide RF signals in all three bands (VHF, UHF, and CEL) along the common signal path of antenna 10, as described earlier, into the vehicle 24, which can then be used for connection via other cables, splitters, or the like, to radio system(s) operative in such bands. Before or after this coupling of a cable to signal feed member 20 of the mounted base assembly 18, the assembly of the antenna elements 12 and 14, adapter member 16, and adjusting member 13 (preferably fixed in a desired distance from adapter member 16) is positioned so that shaft 20*a* of the mounted base assembly 18 is received into the adapter member's hole 16*e*. Threads along the interior wall of hole 16*e* and exterior of shaft 20*a* then mate with each other while tightening shaft 20*a* into hole 16*e*, thereby attaching base assembly 18 to the rest of antenna 10. Although antenna 10 is shown mounted vertically on a vehicle roof, less preferably antenna 10 may extend non-vertically by being mounted on a non-horizontal surface.

Antenna 10 may be mounted onto an automobile, but the antenna may be mounted on other vehicles, such as trucks, boats, or any other vehicle having radio systems operable in the frequency bands of the tri-band antenna 10. Also, although antenna 10 is described for enabling operation in UHF, VHF, and CEL bands, the antenna elements 12 and 14 and distance of adjusting member 13 to adapter member 16 (or with respect to base assembly 18) may differ from those described herein to enable desired antenna 10 performance. For appearance purposes when antenna 10 is mounted, the external surfaces of antenna elements 12 and 13, base member 19, adapter member 16, and adjusting member 13, preferably each have a non-conductive enamel exterior finish of a common color (e.g., black) prior to their assembly as described herein in providing antenna 10.

Antenna elements 12 and 14 are described above as extending parallel, or at least substantially parallel, to each other in a vertical direction and spaced apart from each other in a horizontal direction, or at least substantially horizontal, to their different respective heights. Such represents the preferred embodiment; antenna elements 12 and 14 may extend in other directions by drilling holes 17*a* and 17*b* through adapter element 16 in accordance with the desired directions antenna elements 12 and 14 extend from adapter element 16 when fixed thereto. For example, antenna elements 12 and 14 may extend spaced apart from each other in substantially the same direction vertically or non-vertically, or along different directions, such as at a diverging angle (V-shape). When antenna elements 12 and 13 are not at least substantially parallel to each other, antenna elements 12 and 14 may be drilled through adjusting member holes 13*a* and 13*b* in accordance with the directions of members 12 and 14 from adjusting member 13 prior to fixing antenna elements 12 and 14 to adapter member 16 to assure that adjusting member 13 will be set at the desired distance from adapter member 16 for tuning antenna 10, as described earlier, when antenna element 12 and 14 are fixed to adapter member 16 in antenna 10.

From the foregoing description, it will be apparent that a tri-band antenna has been provided. Variations and modifications of the herein described tri-band antenna will undoubtedly suggest themselves to those skilled in the art. Accordingly, the foregoing description should be taken as illustrative and not in a limiting sense.

The invention claimed is:

1. A tri-band antenna comprising:

a pair of antenna elements each having two opposite ends, in which a first of said antenna elements operates to provide a first frequency band, and a second of said antenna elements operates to provide second and third frequency bands;

a first member fixed to a first of said ends of each of said antenna elements, in which said antenna elements extend from said first member;

a second member couples said antenna elements to each other between said first and second ends of said antenna elements in which said second member is spaced from said first member a distance to adjust the operation of said tri-band antenna in at least said first frequency band; and a third member attachable to said first member to provide said antennal elements, via said first member, with a common signal path for transmission and reception of signals in all three bands.

2. The tri-band antenna according to claim 1 further comprising:

a base member for mounting the tri-band antenna along an external surface of a vehicle, and said third member extends through said base member and has one end attached to the first member and another end providing a connector.

3. The tri-band antenna according to claim 1 wherein said first frequency band is UHF, said second frequency band is VHF, and said third frequency band is for cellular frequencies.

4. The tri-band antenna according to claim 1 wherein said first, second, and third frequencies are separate bands.

5. The tri-band antenna according to claim 1 wherein said antenna elements extend away from said first member spaced apart from each other.

6. The tri-band antenna according to claim 5 wherein said antenna elements extend away from said first member in substantially the same direction.

7. The tri-band antenna according to claim 6 wherein said direction is vertical.

8. The tri-band antenna according to claim 1 wherein said antenna elements extend away from said first member parallel and spaced apart from each other.

9. The tri-band antenna according to claim 1 wherein said second member increases the resonance of said first of said antenna elements which operates in said first band by reducing the presence in said signal path of resonance in said first band of said second of said antenna elements.

10. The tri-band antenna according to claim 1 wherein said second member effects inductance of said antenna elements in said first band more than said second and third bands.

11. The tri-band antenna according to claim 1 wherein said antenna elements are whip antennas in which said second of said antenna elements is longer than said first of said antenna elements.

12. The tri-band antenna according to claim 1 wherein said second member has two holes in which said antenna elements each extend through a different one of said holes.

13. The tri-band antenna according to claim 12 wherein said antenna elements are slidable in said holes of said second member to adjust the operation of said first of said antenna elements in said first frequency band.

14. The tri-band antenna according to claim 1 wherein said first member has two holes for receiving said antenna elements in which said antenna elements are fixed in said holes.

15. A method for providing an antenna having first, second and third separate frequency bands using a pair antenna elements in which one of said antenna elements operates to provide a first frequency band, and the other of said antenna elements operates to provide second and third frequency bands, said method comprising the steps of:

fixably engaging each of said antenna elements to a first member in which said antenna elements extend away from said first member; and coupling a second member to each of said antenna elements spaced a distance from said first member to adjust the operation of at least said one of said antenna elements in said first frequency band.

16. The method according to claim 15 further comprising the step of:

attaching a third member to said first member to provide said antenna elements, via said first member, with a common signal path for transmission and reception of signals in all three bands.

17. The method according to claim 16 further comprising the step of:

attaching a base member for mounting the antenna along an external surface of a vehicle in which said third member extends through said base member prior to carrying out said step of attaching said third member to said first member.

18. A tri-band antenna comprising:

a first vertical antenna element resonant in a UHF band;

a second vertical antenna element resonant in a VHF band and a cellular frequency band;

a first horizontal member having an opening for retaining one end of each of said first and second antenna elements; and a second horizontal member having an opening through which each of said first and second antenna elements extend and said second horizontal member is spaced a distance above said first horizontal member to adjust at least said UHF band of said tri-band antenna.

19. The tri-band antenna according to claim 18 further comprising:

means for mounting said first horizontal element along an external surface of a vehicle and providing a common path for signals in said UHF band, said VHF band, and said cellular band to radio systems in said vehicle.

* * * * *